United States Patent [19]

Morane et al.

[11] Patent Number: 4,860,933

[45] Date of Patent: Aug. 29, 1989

[54] CONTAINER FOR PACKAGING A PRODUCT AND DISPENSING IT UNDER GOOD CONDITIONS OF CLEANLINESS

[75] Inventors: Bruno Morane, Neuilly; Vincent de Laforcade, Vincennes, both of France

[73] Assignee: L'Oreal, Paris, France

[21] Appl. No.: 214,518

[22] Filed: Jul. 1, 1988

[30] Foreign Application Priority Data

Jul. 6, 1987 [FR] France ..... 87 09536

[51] Int. Cl.[4] ..... B65D 83/00

[52] U.S. Cl. ..... 222/402.13; 222/518; 239/590.3

[58] Field of Search ..... 222/149, 190, 394, 402.1, 222/402.13, 402.24, 518; 251/350, 353; 239/117, 337, 343-344, 353-354, 590, 590.3

[56] References Cited

U.S. PATENT DOCUMENTS

| | | | |
|---|---|---|---|
| 3,361,301 | 1/1968 | Meshberg | 222/149 |
| 3,584,789 | 6/1971 | Traynor | 239/117 |
| 4,789,104 | 12/1988 | Anderson | 239/455 |

FOREIGN PATENT DOCUMENTS

| | | |
|---|---|---|
| 0132352 | 1/1985 | European Pat. Off. . |
| 2274849 | 1/1976 | France . |
| 1445202 | 8/1976 | United Kingdom . |

*Primary Examiner*—Michael S. Huppert

*Attorney, Agent, or Firm*—Cushman, Darby & Cushman

[57] ABSTRACT

Products having a viscous or pasty consistency, or those dispensed as foams from a container (1) provided with a pushbutton (13) the actuation of which causes the ejection of a dose of product, are never, in practice, completely evacuated from the ejection conduit (14) made in a movable portion (9) bearing the pushbutton (13) and adapted to the outlet of the container (1). Hence they often threaten to escape from this conduit (14) and soil the container (1). To overcome this disadvantage, the invention proposes that the conduit (14) discharge into a chamber (40) defined by a fixed portion (10) attached to the container (1) and with the movable portion (9) comprising a dispensing cap (8); the chamber (40) opens to the outside via an opening (38), and the movable portion (9) includes a needle (27) capable of closing this opening (38) in the position of repose of the pushbutton (13) and of freeing it upon actuation of the pushbutton.

4 Claims, 2 Drawing Sheets

CONTAINER FOR PACKAGING A PRODUCT AND DISPENSING IT UNDER GOOD CONDITIONS OF CLEANLINESS

FIELD OF THE INVENTION

The present invention relates to the containers used for packaging and dispensing products in the form of a paste or gel, in particular of a self-foaming type, provided with a pushbutton which when actuated causes a dose of product to be ejected and dispensed, via an ejection conduit made in a movable portion which is adapted to the end of the outlet of the container; the pushbutton is integral with the container. In the majority of cases, the conduit terminates in an applicator nozzle of the movable portion, with a view to making it easier for the user to dispense the product at the proper site.

BACKGROUND OF THE INVENTION

Examples of containers of this type include pressurized "aerosol bomb" containers, in which case the aforementioned movable portion comprises a sleeve having the pushbutton and through which the aforementioned ejection conduit extends, the sleeve being intended to effect communication between the outside and the conduit defined by the outlet tube of the dispensing valve.

Products capable of being dispensed from containers of this type particularly include cosmetic products, hygiene products and housekeeping or other maintenance products. In the field of care of the body and hair, the following examples of products packaged in pressurized cans can be given: foaming shaving creams, self-foaming shaving gels, hair dyes, reducing agents for cold permanent waving of the hair, shampoos, depilatories, and makeup removal foams, in particular of the self-foaming type.

In these containers, the product that is ejected flows along the aforementioned conduit until its effective escape from the container. In practically all cases where products of the aforementioned consistency are dispensed, once the user has relaxed the pressure on the pushbutton the ejection conduit does not have time to empty, and so some product remains, in a quantity that is all the greater, the longer the applicator nozzle.

The above products are of a kind such that after the pushbutton has returned to its position of repose, they tend to escape slowly from the reservoir comprised by the ejection conduit (in the case of the foam, by expanding, and in the case of pasty or viscous products by draining out), which dirties the pushbutton or the dispensing cap of the container in general.

It has already been proposed to overcome this disadvantage by assuring the closure of the opening for the definitive escape of the product to outside the container when the pushbutton is in its position of repose, so that this opening is freed only when the pushbutton is actuated. In this way, the reservoir formed at the cap of the container is completely closed in the position of repose of the pushbutton, so that the conditions of cleanliness and hygiene that are sought are attained. The aforementioned opening is made in a fixed portion tht is integrally joined to the container, and it can be closed by a means supported by the movable portion in which the ejection conduit is made. In the known arrangements, the ejection conduit discharges in a sealed manner into a chamber defined by a fixed portion attached to the container, which with the movable portion comprises a dispensing cap; this chamber opens to the outside via the opening that in the position of repose is closed, via a means supported by the movable portion. This movable portion can be terminated by an ejection tube that is closed at its free end by a wall including a plurality of slots, distributed regularly along the periphery, that are fed from the ejection conduit.

However, the applicators used up to now do not permit the precise application, at a predetermined site, of a self-foaming gel. These self-foaming gels are gels which contain the gas necessary for their expansion into foam. The gas is isobutane or isopentane, for example. These self-foaming gels are used more particularly for treating the scalp, and in this case a precise application line by line is often necessary. To obtain a precise application, the nozzle must be long and tapered, and the volume of the chamber into which the conduit discharges is too great for a foam of firm consistency to be obtained.

SUMMARY OF THE INVENTION

The present application relates to a device making it possible to obtain a self-foaming foam of suitable consistency.

The present invention relates to a container for the packaging of a product and dispensing it by actuating a pushbutton, in order to bring about the ejection of the product via an ejection conduit made in a movable portion with which the pushbutton is integrally connected. The ejection conduit discharges into a chamber, which is defined by a fixed portion attached to the container and with the movable portion comprises a dispensing cap. The chamber opens to the outside via an opening. The movable portion including a means capable of closing this opening, in the position of the repose of the pushbutton, and freeing it upon the actuation of the pushbutton. The movable portion of the dispensing cap terminates via an ejection tube which defines the outlet end of the ejection conduit and the axis of which is parallel to the direction in which the pushbutton is actuated, and the ejection tube is closed at its free end by a closure wall arranged to slide in a guide in the fixed portion. The closure means of the opening made in the fixed portion comprises a protuberance supported by the closure wall of the ejection tube, and the closure wall of the ejection tube includes a plurality of slots distributed regularly over the periphery of the wall, and all fed via the ejection conduit. The invention provides that the ejection conduit includes passages each of which discharges vertically of a slot, these passages being fed in parallel via the inlet end of the ejection conduit and being separated from one another by a core.

The closure wall and the core that separates the passages, in a first variant, comprise an element that is molded separately and is wedged by force into the ejection tube until it comes into contact with the wall on the free edge of the ejection tube.

In a second variant, the closure wall and the core which separates the passages are molded with the remainder of the movable portion, and the axes of the outlet tube of the valve of the container and of the ejection tube coincide.

According to the invention, the core that separates the various passages makes it possible to reduce the volume for formation of the foam, and this reduction in the volume makes it possible to obtain a more consistent foam. The present invention also relates to the use of the container for packaging self-foaming gels.

The dimensions of the opening of the fixed portion and the dimensions of the protruberance from the movable portion intended for closing the opening in the position of repose of the pushbutton are preferably selected so that the protuberance will be contained completely in the interior of the outlet chamber of the product when the pushbutton is moved to the end of its course of travel, in the position where the dispensation of the product is assured.

Moreover, the fixed portion of the dispensing head can advantageously comprise a protective cap for the movable portion, this protective cap including an opening that permits free access to the pushbutton by the user, and tapering in the direction of the end of the container, so as to retain the role of an applicator nozzle of the ejection tube.

In an advantageous embodiment, the container is a pressurized container of the "aerosol bomb" type, and the movable portion comprises a sleeve bearing the pushbutton and through which an ejection conduit passes that connects the conduit, defined by the outlet tube of the dispensing valve, with the outlet chamber of the product.

For better comprehension of the subject of the invention, two preferred embodiments, which are given solely by way of illustrative example and are not limiting, will now be described in detail, referring to the drawings.

DESCRIPTION OF THE PREFERRED EMBODIMENTS

Figure 2:
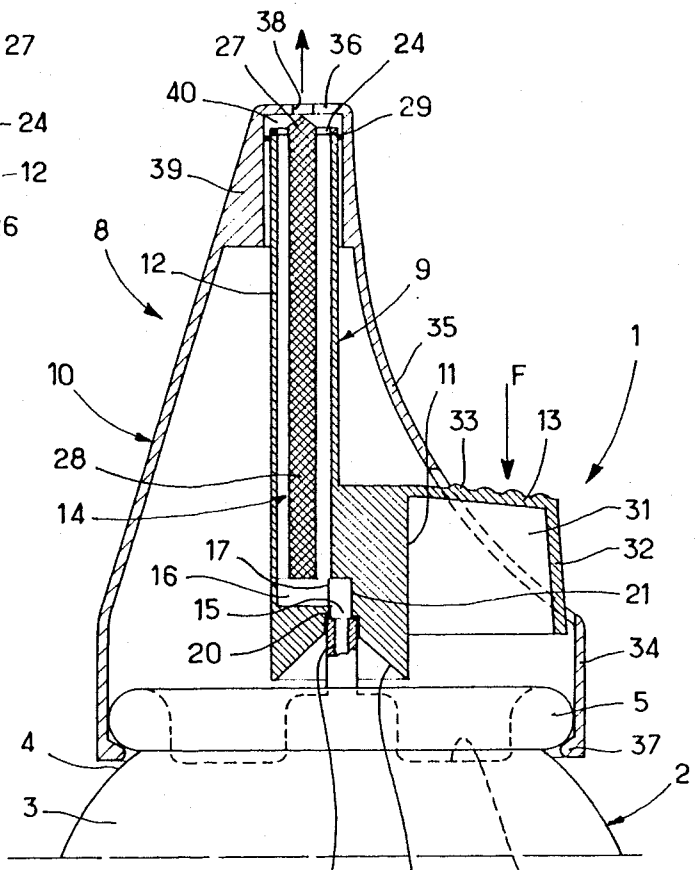
FIG. 2 is a similar view to FIG. 1, showing the apparatus in the position of use, with the pushbutton depressed.
Figure 3:
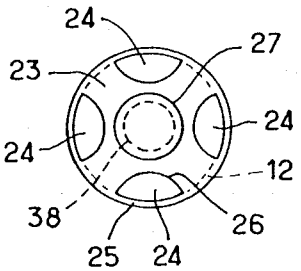
FIG. 3 is a plan view of the upper end of the movable portion of the dispensing cap.
Figure 1:
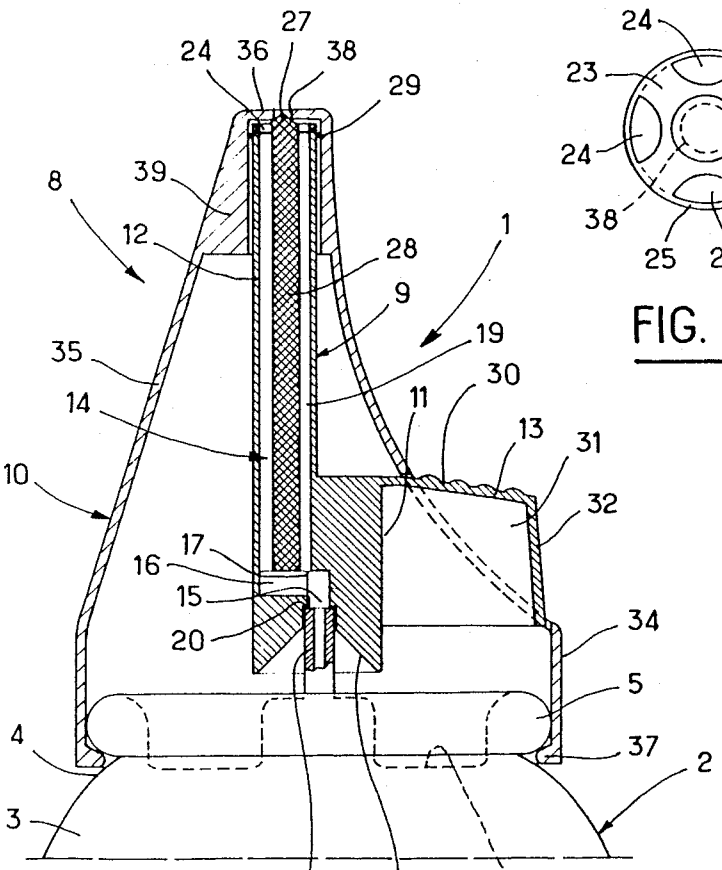
FIG. 1 is an axial sectional view of the upper portion of a pressurized container according to the invention, equipped with its dispensing cap, and the entire apparatus being in the position of repose.

Referring to FIGS. 1–4, it can be seen that reference numeral 1 indicates the entire apparatus of a pressurized container of the "aerosol bomb" type, in which a foaming shaving cream, for instance is packaged, intended for dispensation in the form of a foam as soon as it leaves the container 1. The container includes a body 2 having a cylindrical side wall 3, the upper edge 4 of which is terminated by an annular crimping flange 5 to which a valve-holder collar 6 is affixed in the conventional manner. In the central zone of the valve-holder collar (6) is disposed a valve provided with an outlet tube 7 emerging in the axis of the body 2. If the outlet tube 7 of the valve is depressed, this causes the contents of the container 1 to be exposed to the open air, the contents being projected outside the container by the action of the propellant gas in the container, with the simultaneous production of foam as a consequence of the presence, in the liquid phase, of a foam-producing product and the partial dissolution of the propellant gas in this liquid phase inside the container 1.

A dispensing cap 8 is arranged on the body 2, comprising a movable portion 9 and a fixed portion 10.

The movable portion 9 comprises a sleeve 11, which assures the connection with the outlet tube 7 and is lengthened with a cylindrical tube 12, which because of its relatively great length with respect to the height of the sleeve 11 acts as an applicator nozzle. At the base of tube 12, the side of the sleeve 11 has a pushbutton 13, which makes it possible to control the opening of the valve.

The movable portion 9 has an ejection conduit 14 extending through it, the conduit being intended to lengthen the conduit defined by the tube 7. In the sleeve 11, the conduit 14 includes an inlet branch 15, which is relatively short, discharging into the lower face of the sleeve 11, and an outlet branch 16, disposed parallel to the branch 15 in the axis of the tube 12; the two branches 15 and 16 communicate with one another in the zone 17, because of the intersection of the two cylinders having parallel offset axes that the branches 15 and 16 comprise.

The base of the sleeve 11 comprises a frustoconical wall 18 along the axis of which the tube 7 is positioned. The upper edge of the tube 7 is housed in an annular shoulder 20 made at the base of a branch 15 of the conduit 14.

Figure 4:
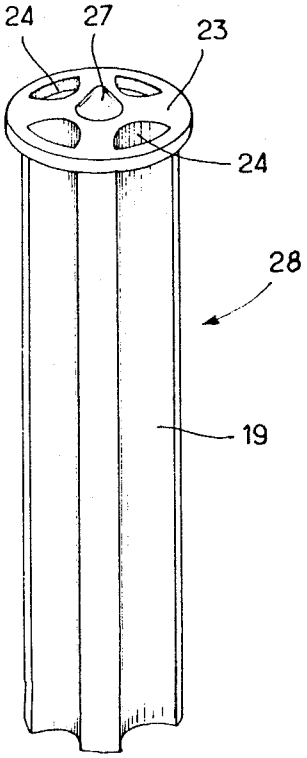
FIG. 4 is a perspective view of the elongated element that is wedged by force into the ejection tube of the movable portion of the dispensing cap of FIGS. 1–3.

The branch 16 is extended by the conduit defined by the tube 12. This tube is closed at its free end with a closure wall 23, which is perpendicular to the axis of the tube 12. The wall 23 is independent of the tube 12; it is in the form of a disk having a diameter substantially equal to the outside diameter of the tube 12. An element in the form of a rod 28, which may be molded with the wall 23 and thus with it comprises the elongated element represented in FIG. 4, is connected axially to one of the two faces of the wall 23. The element 28, of substantially cylindrical form and having a diameter equal to or slightly less than the inside diameter of the tube 12, includes four longitudinal grooves 19 distributed regularly over its periphery; these grooves 19 discharge into the wall 23 to form four slots 24. Each slot 24 is thus defined on the one hand by an outer edge 25, made vertically of the end of the wall of the tube 12 and, on the other hand, by an inside edge 26, comprising the end of the associated groove 19, and the concavity of which is opposite that of the edge 25 and includes a shorter radius of curvature.

The element 28 is joined to the remainder of the movable portion by being wedged by force into the tube 12 until it comes into contact with the wall 23 at the free edge of the tube 12. In this position, the element 28 extends in the conduit 14 and in the branch 16 as far as the zone of communication 17 between the branches 15 and 16.

Thus four parallel passages, each discharging vertically of one slot 24, are defined in the branch 16 of the conduit 14, the four passages being fed in parallel via their base and via the outlet tube 7 of the valve.

Moreover, the closure wall 23 has a central protuberance 27 on its outside, in the form of a conical needle.

The side wall of the tube 12 also has a sealing ring 29, which is molded with the tube 12, in the vicinity of the closure wall 23.

The pushbutton 13, as has been noted above, comprises a lateral extension of the sleeve 11, at the base of the tube 12. The pushbutton 13 is a hollow element defined, first, by an upper wall 30, which is ridged to make it easier for the user to push it with his finger, when he exerts pressure on this wall 30 to dispense the foam; second, by two substantially radial side walls 31 which are connected to the cylindrical side wall of the sleeve 13; and third, by a frustoconical external side wall 32, which is located substantially vertically of the flange 5.

The fixed portion 10 of the dispensing head 8 comprises a cap that covers the movable portion 9 placed on the body of the container 1. The portion 10 includes an annular footing 34 and a side wall 35 connected to a base 36. The footing 34 comprises a cylindrical rod the lower free edge of which supports an inner locking flange 37, which in a seated position of the cap 8 locks into place on the crimping flange 5.

The side wall 35 is in a tapered form, up to its junction with the base 35. This tapered form makes it possible to retain the role of applicator nozzle for the end zone of the container 1, which is useful in the intended use of the container. Moreover, the side wall 35 includes an opening by way of which the pushbutton 13 can project; the curved shape, with a concavity oriented toward the outside, that the side wall 35 assumes in this region does not impede the actuation of the pushbutton 13.

The base 36 comprises a disk having a dimeter slightly greater than that of the end wall 23 of the ejection tube 12; in the seated position of the cap 8, it comes into the place above this wall 23 and parallel to it, being centered on the axis of the tube 12. This base 36 also has a central opening 38 of circular form, the diameter of which is less than that of the base of the needle 27. The height of the cap 10 is selected so that in the position of repose of the movable portion 9, the needle 27 closes the opening 38 of the base 36.

The wall 35 is also thickened in the vicinity of the base 36, such that in this zone the inside wall of the cap 10 is a cylindrical wall, having an axis perpendicular to the base 36 and centered on this base 36, the diameter of this cylinder being slightly greater than that of the tube 12. This zone thus comprises a guide 39 for the tube 12 when the pushbutton 13 is being actuated.

A foaming preparation that includes a propellant gas, in combination with the active substances to be dispensed, is packaged in conventional fashion in the container 1. Then, the dispensing cap 8 is made by providing the tube 12 with the movable portion 9, previously equipped with its element 28, in the cylindrical guide 39 of the fixed portion 10, with relative orientation of the two portions 9 and 10 so that the pushbutton 13 will project outside the portion 10. Then, the dispensing head is placed above the body 2, along the axis, and it is moved downward until it snaps into place with the flange 37 on the crimping flange 5. This position is the position of repose shown in FIG. 1, where the needle 27 closes the opening 38.

When the user wishes to dispense a dose of product contained in the container 1, he presses the pushbutton 13, in accordance with the arrow F (FIG. 2), causing the wedging of the tube 7 so that it rests on the sleeve 11 and the ejection of the dose, liberated in the form of foam, in the conduit of the tube 7, then into the conduit 14, and finally, via the slots 24, into the chamber 40 defined by the wall 23, the flange 29, the lateral wall of the guide 39 and the base 36. This chamber 40 opens to the outside via the opening 38 by way of which the dose of product is then ejected. In this position, the needle 27 is entirely contained in the space inside the chamber 40. When the user relaxes the pressure on the pushbutton 13, the internal spring with which the valve is equipped causes the pushbutton 13 to rise, which causes the reverse translation of the tube 12, which slides in its cylindrical guide 39 until the total closure of the opening 38 by the needle 27. In this way, the fraction of product remaining in the conduit 14, which is in the form of a foam that threatens to escape by expansion, has no possibility of leaving the container 1; as a result, the container remains in its initial state of cleanliness.

Figure 6:
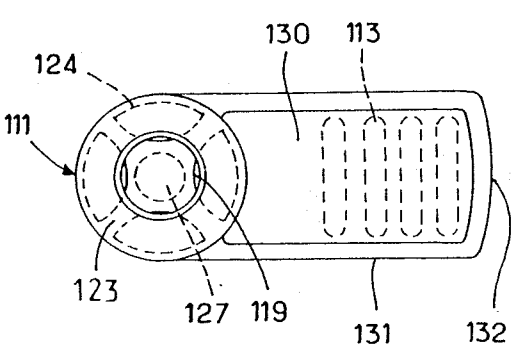
FIG. 6 is a view from below of the movable portion of the dispensing cap of the container of FIG. 5.
Figure 5:
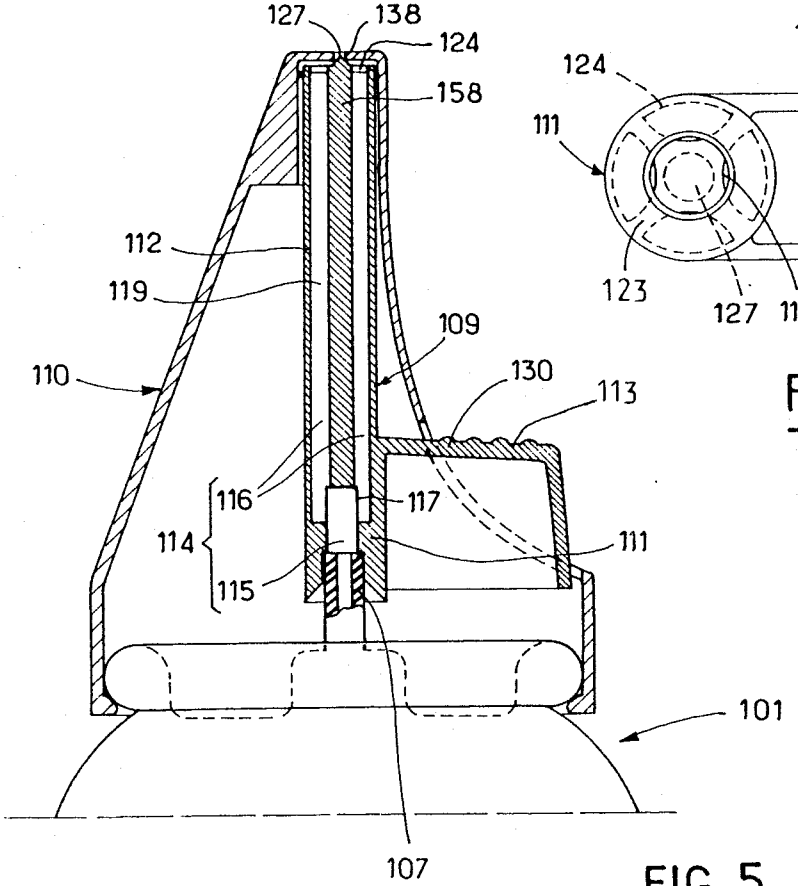
FIG. 5 is a view similar to FIG. 1 of a pressurized container in a variant embodiment of the present invention.

FIGS. 5 and 6 of the accompanying drawing show a variant embodiment of the container according to the invention, which differs substantially from the first in the configuration of the movable portion of the dispensing cap. The elements that are identical in both embodiments shown are distinguished by reference numerals raised by 100 in the variant embodiment, by comparison with those of the first embodiment described.

In this embodiment, the axis of the tube 112 coincides with the axis of the outlet tube 107 of the valve with which the container 101 is equipped. Under these conditions, the movable portion 109 can be molded in one piece.

The branch 116 of the ejection conduit 114 provided in the tube 112 includes, as before, four grooves 119 separated by a core 158. The core 158 is integral with the closure wall 123, which defines the end of the tube 112 opposite the sleeve 111, and is also integral with the cylindrical wall tht defined the tube 112, the wall 123 includes four openings 124 in the extension of the grooves 119; it is molded integrally with the tube 112. The branch 115 of the ejection conduit 114 is a cylindrical opening made at the base of the core 158; this cylindrical recess intersects with the walls that define the grooves 119, in order to make a zone of communication 117 between the branches 115 and 116 of the ejection conduit 114. The base of the sleeve 111 is identical to that of the sleeve 11 and receives the outlet tube 107 of the valve of the container 101. The movable portion 109 includes a pushbutton 113 identical to that in the embodiment of FIG. 1. The fixed portion 110 is identical to the fixed portion 10; an opening 138 hence cooperates with a conical needle 127 supported by the wall 123.

The molding of the movable portion 109 in a single piece is accomplished by using a cylindrical pin in the mold to define the base of the sleeve 111 and the branch 115 of the ejection conduit and four pins to define the grooves 119 and the openings 124; these four pins come to rest on the grooves via their end opposite the end of the opening 124, in order to define the zones of communication 117.

The functioning and advantages of this variant are the same as those defined by the first embodiment.

It will be understood that these embodiments described here are in no way limiting and may be modified in any desirable way without departing from the scope of the invention.

What is claimed is:

1. A dispensing device for mounting on a container of the type having an ejection duct on one end thereof which, upon movement thereof, results in dispensing of the product through the duct, said dispensing device comprising a cap for mounting in a fixed position on the one end of the container about the dispensing duct, said cap including an ejection outlet and a dispensing portion movably carried in said cap and including an ejection tube having one end for establishing flow communication with the ejection duct of the container and another end located proximately to said ejection outlet of said cap, said ejection tube having means for closing said ejection outlet of said cap, said dispensing portion including push means for moving said dispensing portion from a first position of repose wherein said means for closing closes said ejection outlet of said cap to a second position for dispensing wherein said dispensing member moves the ejection duct of the container and moves said closing means away from said ejection outlet of said cap to allow dispensed product to travel along said ejection tube and out of said ejection outlet, said cap having guide means adjacent said ejection outlet for receiving a portion of said ejection tube, said ejection tube having an end wall provided with peripheral openings for the product, said openings being disposed about said closing means, said ejection tube further including core means defining with said ejection tube a plurality of passages along the interior of said ejection tube and communicating with said peripheral openings in said end wall at said one end of said ejection tube and being in flow communication with the ejection duct of the container at the other end thereof.

2. The invention as claimed in claim 1 wherein said end wall and said core means are each separately molded elements which are force fitted into said ejection tube whereby said end wall lies adjacent said one end of said ejection tube and said core means abuts said end wall.

3. The invention as claimed in claim 1 wherein said end wall and said core means are integrally molded with said dispensing portion with said ejection tube being axially alignable with the ejection duct of the container.

4. The invention as claimed in claim 1 wherein said container contains a self-foaming gel.

* * * * *